US005390418A

United States Patent [19]

Buono et al.

[11] Patent Number: 5,390,418

[45] Date of Patent: Feb. 21, 1995

[54] TOOL FOR DRAWING CIRCUMFERENCES

[76] Inventors: Patricio A. Buono, 10725 Véritz St.; Ramiro A. Buono, 10920 San Salvador St., both of (7600) Mar del Plata, Buenos Aires, Argentina

[21] Appl. No.: 95,553

[22] Filed: Jul. 26, 1993

[51] Int. Cl.[6] ..... B43L 9/04

[52] U.S. Cl. ..... 33/27.03; 33/565

[58] Field of Search ..... 33/27.01, 27.03, 565

[56] References Cited

U.S. PATENT DOCUMENTS

| | | | |
|---|---|---|---|
| 1,154,673 | 9/1915 | Van Ness | 33/27.03 |
| 2,631,376 | 3/1953 | Callahan | 33/27.03 |
| 3,460,261 | 8/1969 | Frey | 33/27.03 |
| 3,465,445 | 9/1969 | Fisher | 33/27.03 |
| 3,900,956 | 8/1975 | Furuoka et al. | 33/565 |
| 4,251,920 | 2/1981 | Cassaones | 33/565 |
| 4,530,156 | 7/1985 | Kettlestrings | 33/562 |
| 4,594,792 | 6/1986 | Cramb | 33/562 |

FOREIGN PATENT DOCUMENTS

| | | | |
|---|---|---|---|
| 0217974 | 4/1987 | European Pat. Off. | 33/27.03 |
| 2582991 | 12/1986 | France | 33/565 |
| 8904770 | 6/1989 | WIPO | 33/27.03 |

*Primary Examiner*—Thomas B. Will
*Attorney, Agent, or Firm*—Keck, Mahin & Cate

[57] ABSTRACT

A tool for drawing circumferences includes a main plate having at least one through opening and at least one disc plate located within the through opening of the main plate. Both plates are contained in a common plane. The disc plate is rotatable around an axis normal to the common plane, the axis passing by a geometrical center of the disc plate. The disc plate has a plurality of through orifices located at different distances from the geometrical center of the disc plate, each orifice forming a pass for a drawing device. The through opening of the main plate defines an inner edge of the main plate, the inner edge having a locking device for interengaging a peripheral groove formed in an outer peripheral edge of the disc plate. The locking device includes at least one radially resilient tongue formed in the plate by at least one cut transversely extending to the inner edge of the main plate so that the tongue elastically yields along a substantially radial direction.

11 Claims, 2 Drawing Sheets

TOOL FOR DRAWING CIRCUMFERENCES

FIELD OF THE INVENTION

The present invention relates to a tool for drawing circumferences and more particularly refers to a portable plate assembly formed by at least two plates contained in a common plane for drawing circumferences of different diameters with precise sizes.

More particularly, the tool of the present invention is one preferably used by arquitects, draftsmen, school pupils and any other person who wish to draw circumferences, circles or any other Figure the lines of which may include at least circumference portions.

BACKGROUND OF THE INVENTION

It is well known in the art of drawing circumferences, the drawing compass comprising at least two articulated arms, one arm having a sharp pin for puncturing the sheet of paper on which the drawing is made, and the other arm having an end with a graphite for drawing the circle. Anyone who has used this drawing tool knows about its inconveniences insofar as to the damages done on the drawing and particularly in the sheet of paper.

There are also many drawing plates having a plurality of cut-out circles having different diameters so as the draftsman may draw a circumference by inserting the pen in the selected cut-out circle and running the tip of a pen around the periphery of the cut-out circle. The cut-out circles have different diameters the values of which are indicated on the plate.

In order to have a convenient variety of circle sizes, the plate must have a large size to include all the necessary circle diameters. Otherwise, many drawing plates are necessary for containing at least the most usual diameter sizes.

SUMMARY OF THE INVENTION

In view of the drawbacks of the conventional tools for drawings circumferences available in the market, the inventor feels that it is necessary to count with a simple, little, portable and easy-to-use tool for drawing circumferences, with, however, a wide number of circumference diameters and precise indication of the diameter sizes for the different circumferences that may be drawn by the tool.

In view of the foregoing, it is an object of the present invention to provide a tool for drawing circumferences, which is a portable tool, having a little size so as the tool can even enter in the pencil case of a pupil. However, in spite of its little size, the tool of the present invention makes possible to draw circumferences with a wide varity of diameter sizes.

It is an object of the present invention to provide a tool for drawing circumferences comprising a main plate having at least one through opening and at least one disc plate located within the through opening of the main plate, both plates contained in a common plane, the disc plate being rotatable around an axis normal to the common plane, the disc plate having a plurality of through orifices located at different distances from a geometrical center of the disc plate, each orifice forming a pass for a drawing point of a drawing device.

It is another object of the invention to provide a tool for drawing circumferences comprising a main plate having at least one through opening and at least one rotating plate located within the through opening of the main plate, both plates being contained in a common plane, the rotating plate being rotatable around an axis normal to the common plane, the axis passing by a geometrical center of the rotating plate, the rotating plate having a plurality of through orifices located at different distance from the geometrical center of the rotating plate, each orifice forming a pass for a drawing point of a drawing device.

It is another object of the present invention to provide a tool for drawing circumferences wherein adjacent each through orifice there is an indicia of the diameter value of the circumference associated to the selected orifice.

Other objects and advantages of the invention will be aparent from the following specification on the accompanying drawings which are for the purpose of illustration only.

BRIEF DESCRIPTION OF THE PREFERRED EMBODIMENTS

Figure 1:
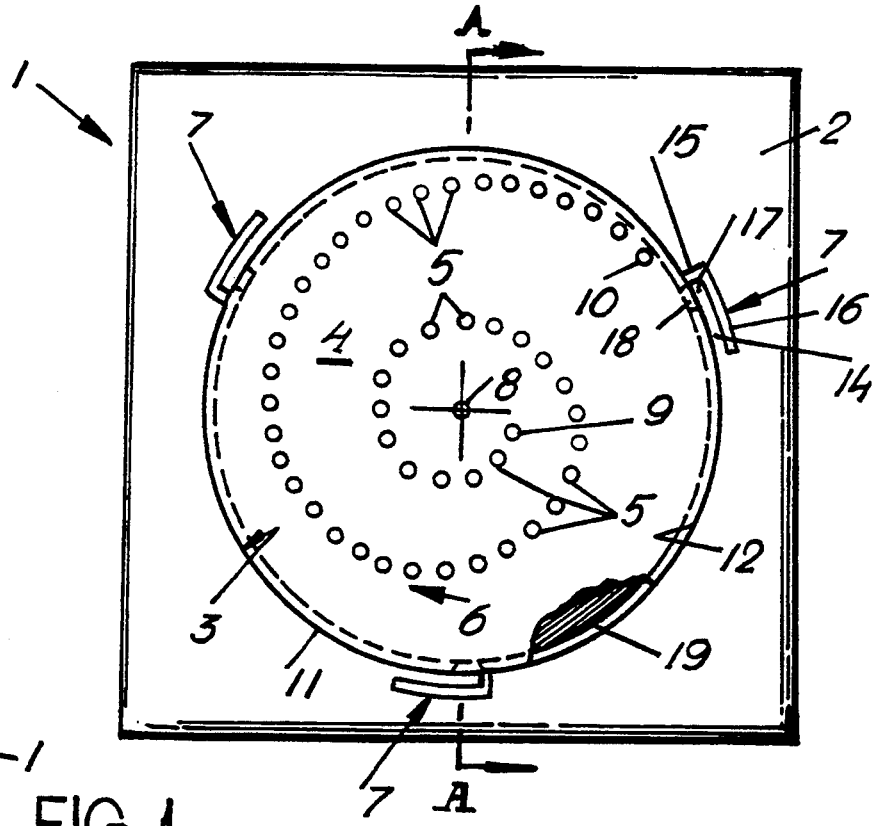
FIG. 1 is a front view of a first embodiment of the tool for drawing circumferences in accordance with the present invention.
Figure 2:
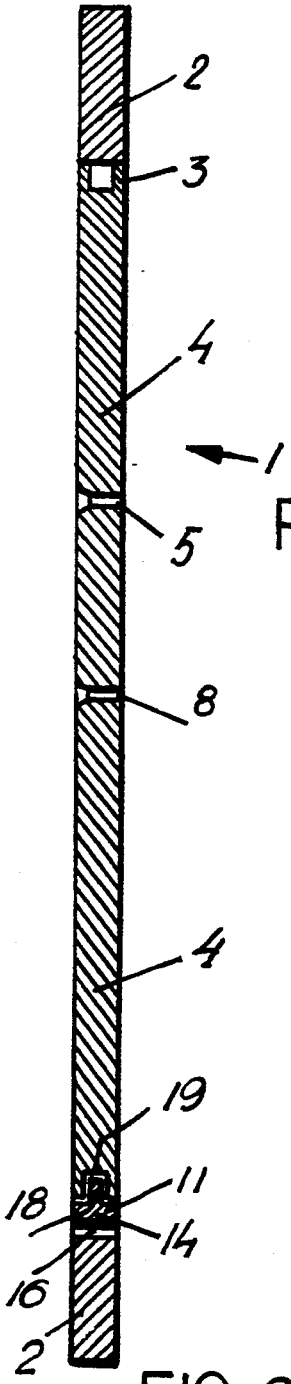
FIG. 2 is an enlarged cross-section view taken along line A—A of FIG. 1.

Making reference to FIGS. 1 and 2, it may be seen that the tool of the present invention, generically indicated by reference number 1, comprises a square or rectangular main plate 2 having a through opening 3. The through opening 3 may have a circular shape or any other convenient shape so that a disc plate 4 may be inscribed within the opening 3 to rotate.

This plate 4 is preferably made of the same material from which main plate 2 has been manufactured, generally this material is plastics. This plate 4 has a geometrical center which forms a central orifice 8. A plurality of through orifices 5 is arranged all over the front surface of the disc plate 4 passing through the thickness of plate 4 as it may be seen in FIG. 2. Orifices 5 are preferably arranged in an alignment manner to define a spiral pattern 6. This is very useful to include a wide variety of circumferences that may be drawn, including all the diameter sizes from a minimum diameter defined by orifice 9, the closest one to center 8, the maximum diameter defined by the orifice 10 located the closest to the periphery 11 of plate 4.

In order to draw circumferences, tool 1 is placed over the sheet of paper wherein the circumference is to be drawn, the central orifice 8 must be placed to coincide with the geometrical center of the circumference to be drawn. The diameter size is selected from the several orifices 5, which will have indicia of the corresponding diameter size on the front surface of disc plate 4. The graphite of a pencil or any other drawing tip of, for example, a pen, is introduced in the selected orifice 5 and plate 4 is caused to rotate, by means of the pen, around center orifice 8. As plate 4 is circunscribed within opening 3, the disc plate 4 will easily rotate within this opening 3.

To keep this plate 4 conveniently retained within opening 3, locking means 7 are provided in the inner edge of main plate 2, defined by the cut-out opening 3.

Each locking means 7 comprises an elastical or yieldable tongue 14 formed in the main plate 2 by means of a radial cut 15 and a circular cut 16. The cut 15 is normal to the inner edge 12 of the main plate 2 while the cut 16 is circular or substantially paralell to edge 12 so as to allow tongue 14 to move elastically. In fact, cut 16 should have an enough width to allow a distal end 17 of tongue 14 to yield radially along a distance defined by the width of circular cut 16. A distal end 17 of tongue 14 has, in the portion thereof forming part of inner edge 12, a radially extended projection 18.

The peripheral outer edge 11 of disc plate 4 has a peripheral groove 19 the purpose of which is to engage projection 18 to keep disc plate 4 rotatably retained within opening 3 of main plate 2. For assembling main plate 2 and disc plate 4, disc plate 4 is located over opening 3 and is pushed into opening 3 to cause distal end 17 to move radially awardly so as to enter this plate 4 into opening 3. When disc plate 4 is almost entirely within opening 3, projections 18 will enter the peripheral groove 19 so as to retain plate 4 into plate 2.

Although orifices 5 may be arranged in a wide different pattern, spiral pattern 6 shown in FIG. 1 is preferred.

Figure 3:
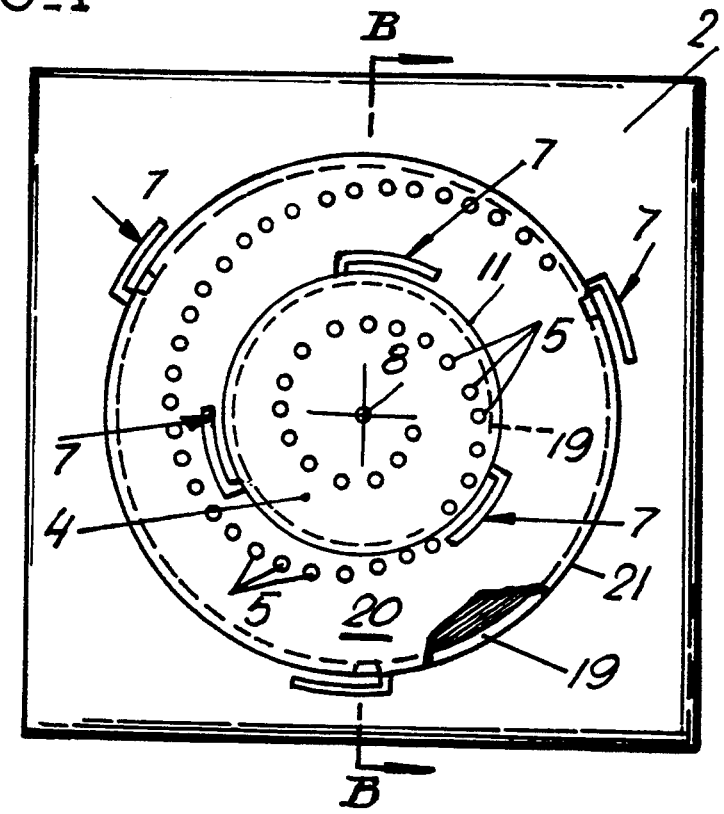
FIG. 3 is a front view of a second embodiment of the tool for drawing circumferences according to the present invention.

In FIG. 3 a second embodiment of the tool of the present invention is shown. The equivalent parts are indicated with the same reference numbers used for describing FIGS. 1 and 2. The difference between the present embodiment and that one of FIGS. 1 and 2 is that an annular plate 20 is located between the main plate 2 and disc plate 4.

Locking means 7 of main plate 2 will engage groove 19 located in an outer peripheral edge 21 of annular plate 20 while annular plate 20 will have second locking means 7, identical to locking means 7 of main plate 2, that engages a peripheral groove 19 formed in outer peripheral edge 11 of disc plate 4.

It is evident for any person skilled in the art that more than one annular plates 20 may be located between main plate 2 and disc plate 4.

Figure 4:
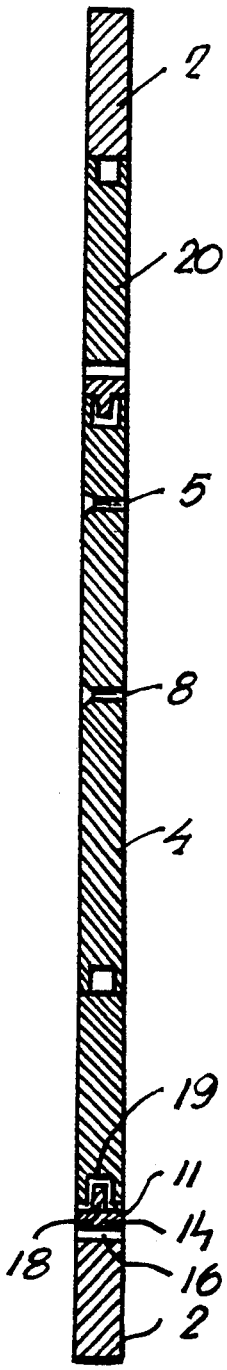
FIG. 4 is an enlarged cross-sectional view taken along line B—B of FIG. 3.
Figure 5:
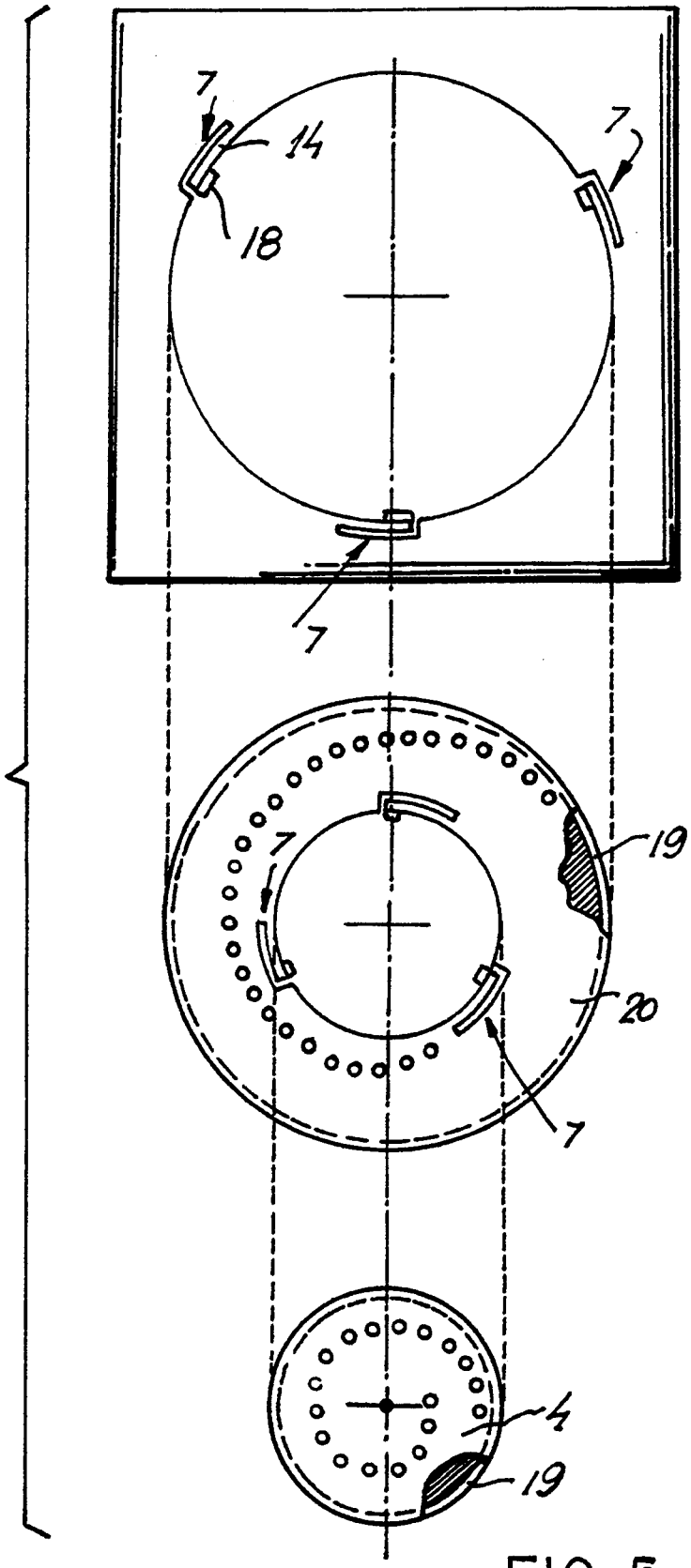
FIG. 5 is an exploded front view of the tool of FIGS. 3 and 4.

Finally, FIG. 5 shows an exploded view of the embodiment shown in FIGS. 3 and 4, wherein locking means 7 with tongue 14 and projection 18 for engaging groove 19 area clearly shown.

As it is shown in FIG. 2, projection 18 will preferably have tappered walls so as to facilitate the insertion of disc plate 4 within opening 3 of main plate 2. The same concept is applied to projections 18 of the embodiment shown in FIGS. 3 to 5.

Although the thickness of plates 2, 4 and 20 may have been exaggerated for clarity purposes, it is evident that the same will have the thickness that is conventional for this type of drawing tools.

Although the principles of the present invention have been herein illustrated in particular embodiments of the tools for drawing circumferences of the present invention, it is not intended to limit such principles to those constructions alone, since the same principles are readily adaptable to various other forms of drawing tools. Thus, the various principles of the present invention should be barely construed and not limited beyond the specific limitations set forth in the appended claims including the pattern equivalents thereof.

We claim:

1. A tool for drawing circumferences comprising a main plate having at least one through opening and at least one disc plate located within the through opening of the main plate, both plates being contained in a common plane, the disc plate being rotatable around an axis normal to the common plane, the axis passing by a geometrical center of the disc plate, the disc plate having a plurality of through orifices located at different distances from the geometrical center of the disc plate, each orifice forming a pass for a drawing device, the through opening of the main plate defining an inner edge of the main plate, the inner edge having locking means for interengaging a peripheral groove formed in an outer peripheral edge of the disc plate, the locking means comprising at least one radially resilient tongue formed in the plate by a radial cut and a circular cut adjacent to the inner edge of the main plate so that the tongue elastically yields along a substantial radial direction.

2. A tool for drawing circumferences according to claim 1, wherein the tongue has a distal end that includes a projection extended radially out of said inner edge and which enters the groove of the disc plate.

3. A tool for drawing circumferences according to claim 1, wherein the orifices are aligned to form a spiral pattern.

4. A tool for drawing circumferences according to claim 1, wherein the geometrical center comprises a central through orifice.

5. A tool for drawing circumferences comprising a main plate having at least one through opening and at least one rotating plate located within the through opening of the main plate, both plates being contained in a common plane, the at least one rotating plate being rotatable around an axis normal to the common plane, the axis passing by the geometrical center of the rotating plate, the rotating plate having a plurality of through orifices located at different distances from a geometrical center of the rotating plate, each orifice forming a pass for a drawing point of a drawing device, the at least one rotating plate comprising at least one annular plate and a central disc plate, the rotating plate and the disc plate being concentrically located in the through opening of the main plate, the through opening of the main plate defining an inner edge of the main plate, the inner edge having first locking means for interengaging a peripheral groove formed in an outer peripheral edge of the annular plate, the annular plate having an inner edge with second locking means for interengaging a peripheral groove formed in an outer peripheral edge of the central disc plate, the first and the second locking means comprising respectively at least one radially resilient tongue formed in the inner edge of the respective through opening and annular plate by a radial cut and a circular cut adjacent to the respective inner edge, so that the tongue elastically yields along a substantially radial direction.

6. A tool for drawing circumferences according to claim 5, wherein the tongue has a distal end that includes a projection radially extended from the inner edge of the respective through opening and annular plate, for entering in the respective peripheral groove of the annular plate and central disc plate.

7. A tool for drawing circumferences according to claim 6, wherein the through orifices in the annular and central disc plate are aligned to form a spiral pattern.

8. A tool for drawing circumferences, comprising a main plate having at least one through opening and at least one disc plate located within the through opening of the main plate, both plates being contained in a common plane, the disc plate being rotatable around an axis normal to the common plane, the axis passing by a geometrical center of the disc plate, the disc plate having a plurality of through orifices located at different distances from the geometrical center of the disc plate, each orifice forming a pass for a drawing device, the through opening of the main plate defining an inner edge of the main plate, the inner edge having locking means for interengaging a peripheral groove formed in an outer peripheral edge of the disc plate, the locking means comprising at least one radially resilient tongue formed in the plate by means of at least one cut transversely extending to the inner edge of the main plate so that the tongue elastically yields along a substantially radial direction.

9. A tool for drawing circumferences according to claim 8, wherein the tongue has a distal end that includes a projection extended radially out of said inner edge and which enters the groove of the disc plate.

10. A tool for drawing circumferences according to claim 8, wherein the orifices are aligned to form a spiral pattern.

11. A tool for drawing circumferences according to claim 8, wherein the geometrical center comprises a central through orifice.

* * * * *